United States Patent [19]

D'Angelo et al.

[11] Patent Number: 4,955,329

[45] Date of Patent: Sep. 11, 1990

[54] VALVE UNIT FOR AN INTERNAL COMBUSTION ENGINE INTAKE DUCT, COMPRISING NON-RETURN FLAP VALVES

[75] Inventors: Domenico D'Angelo, Monza; Marco Visconti, Bollate, both of Italy

[73] Assignee: Alfa Lancia Industriale S.p.A., Arese, Italy

[21] Appl. No.: 321,868

[22] Filed: Mar. 10, 1989

[30] Foreign Application Priority Data

Mar. 14, 1988 [IT] Italy ..... 19766 A/88

[51] Int. Cl.[5] ..... F02M 35/00

[52] U.S. Cl. ..... 123/52 MF; 137/855

[58] Field of Search ..... 123/52 MF, 73 V, 65 V, 123/73 A, 73 B, 73 C; 137/855, 856

[56] References Cited

U.S. PATENT DOCUMENTS

| | | | |
|---|---|---|---|
| 1,672,436 | 6/1928 | Thege | 137/856 |
| 4,257,458 | 3/1981 | Kondo et al. | 137/855 |
| 4,422,416 | 12/1983 | Bernardoni | 123/52 MF |
| 4,471,812 | 9/1984 | Bertsch | 137/855 |

FOREIGN PATENT DOCUMENTS

| | | | |
|---|---|---|---|
| 547305 | 10/1957 | Canada | 137/856 |
| 207643 | 7/1959 | Fed. Rep. of Germany | 137/856 |
| 2320484 | 4/1977 | France . | |
| 512632 | 9/1939 | United Kingdom . | |
| 2125483 | 3/1984 | United Kingdom . | |

*Primary Examiner*—David A. Okonsky

*Attorney, Agent, or Firm*—Charles E. Brown; Charles A. Brown

[57] ABSTRACT

The valve unit comprises non-return valves disposed within the intake duct and formed from longitudinal channels and flaps which engage these latter. The channels are provided with seal gaskets at their edges and are formed with their base walls shaped on their outer side in such a manner as to improve the valve reliability and life. The flaps comprise fixing tabs which are clamped between ledges and support surfaces of the superposed channels.

5 Claims, 2 Drawing Sheets

VALVE UNIT FOR AN INTERNAL COMBUSTION ENGINE INTAKE DUCT, COMPRISING NON-RETURN FLAP VALVES

This invention relates to a valve unit for an intake duct feeding air or mixture to a cylinder of an internal combustion engine, preferably of four-stroke type, the unit comprising non-return flap valves in series with the normal intake valve (or valves), their purpose being to retain any fresh mixture charge which may flow back from the cylinder into the duct during cross-over at the end of the intake stroke.

It is well known that in internal combustion engines with fixed timing, the chosen opening advance and closure retardation angles for the valves, in particular the intake valves, are such as to be optimised only at determined engine speeds, whereas at other speeds they represent a compromise which is sometimes only just acceptable.

The intake valves are made to open while the exhaust valves are still open (cross-over), and while this facilitates discharge of the gaseous combustion products at certain engine speeds, at other speeds it results in return flow of these gaseous combustion products from the exhaust into the cylinders and intake ducts, so reducing the volumetric efficiency of the engine.

The intake valves can also be made to close after the compression stroke has commenced in order to improve cylinder filling at high speeds, by inertial and resonance effects.

However at low speeds, because of the reduced inertia of the feed entering the cylinders, at the commencement of the compression stroke a considerable part of the feed can be forced to again enter the intake ducts through the still open intake valves, so worsening cylinder filling.

To obviate these drawbacks it has been proposed to provide the intake ducts with non-return valves which allow the air or mixture to flow towards the cylinders but not in the reverse outward direction, by retaining in the intake ducts any feed which has flown back from the cylinders.

Various inventions are known relating to ducts fitted with non-return valves, and the present applicant has proposed a particularly efficient arrangement in Italian patent No. 1,133,711.

The object of the present invention is to further improve the aforesaid arrangement, particularly with regard to its reliability and life, while retaining its already excellent characteristics of permeability and fast response. The present invention therefore provides a valve unit for an intake duct feeding an internal combustion engine cylinder, comprising a plurality of longitudinal channels with a substantially arcuate base wall which are assembled into superposed modules, and a plurality of elastically flexible flaps associated with said channels for the purpose of opening and closing them, so as to form a unit consisting of non-return valve means, in series with the usual intake valve or valves, said unit being characterised in that said channels in correspondence with their inlet section comprise ledges and support surfaces which when the channel modules are superposed clamp between each other the fixing tabs provided on said flaps, and in correspondence with their outlet section comprise edges covered with sealing material. With this construction the sealing material is disposed only in certain of the contact regions between the flaps and the channel edges, namely where it serves to provide effective sealing and to deaden the impact against the flaps, whereas it is not provided in the flap clamping regions where it would reduce the cross-section at the inlet of the channels, but where in any case good sealing is provided by the fixing of the flap tabs between the ledges and support surfaces of the superposed channel modules. Preferably, on the outer side of their base wall said channels comprise end-of-travel surfaces for halting the flaps in their open position, these surfaces having the same profile as the flaps when deformed under a uniformly distributed load (corresponding to a determined pressure difference), and also comprise step-shaped regions which connect said end-of-travel surfaces to said support surfaces.

With these arrangements, the flaps when in their end-of-travel position are properly supported by the base walls of the overlying channels, so minimising any deformation arising from fatigue stress which could damage them, compromise their life and impede their movement into a completely open position, so reducing the air passage cross-section.

In addition, the provision of said step-shaped regions between the end-of-travel surfaces and the support surfaces enables the stresses on the flaps in proximity to their fixing to be controlled very precisely because the surfaces of the step-shaped connection region can be machined to very narrow tolerances and can therefore be constructed with perfectly definable dimensions to limit the stresses to within design specifications.

The non-return valves constructed in this manner form very compact units which can be mounted in those portions of the intake ducts provided within the cylinder head, to minimise the space between the intake valves and the non-return valves.

Characteristics and advantages of the invention will be apparent from the description given hereinafter with reference to FIGS. 1–4 which show a preferred embodiment of the invention by way of non-limiting example.

Figure 1:
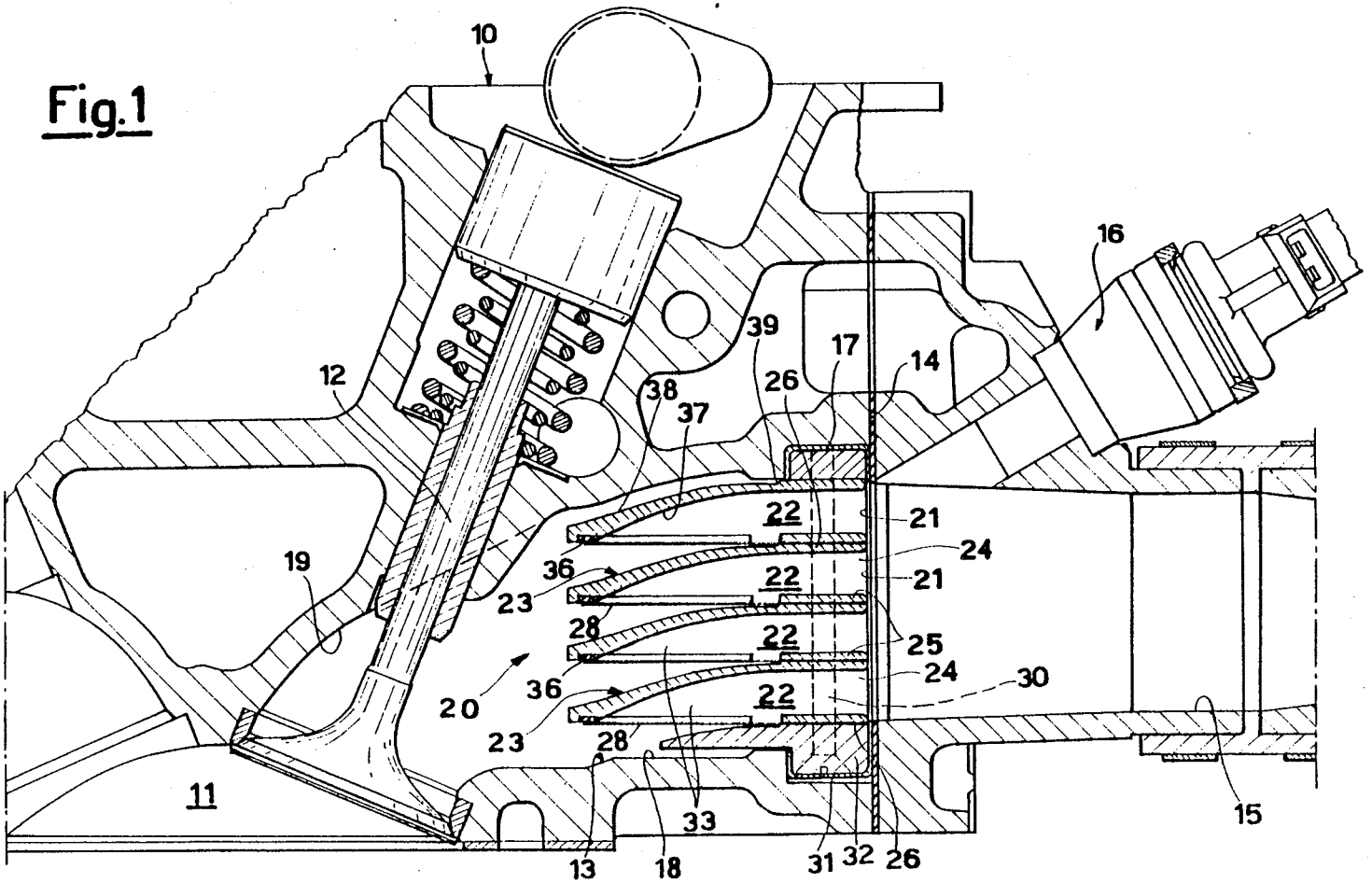
FIG. 1 is an axial section through an internal combustion engine intake duct fitted with non-return valves according to the invention.

In FIG. 1 the reference numeral 10 indicates overall the cylinder head of a four-stroke internal combustion engine which is provided with an explosion chamber such as that indicated by 11, and intake valves such as the valve 12, and which also comprises intake duct terminal portions such as that indicated overall by 13. To the cylinder head 10 there are flanged by way of gaskets, such as that indicated by 14, intermediate intake duct portions, such as that indicated by 15, in which petrol injectors such as that indicated by 16 are disposed. The usual feed throttle valve or valves are not shown.

Figure 2:
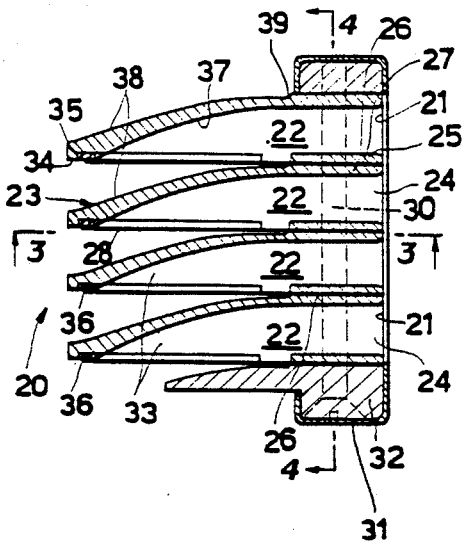
FIG. 2 is a view of a detail of FIG. 1.
Figure 3:
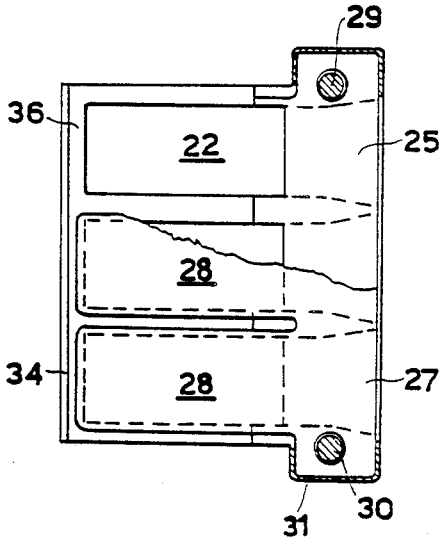
FIG. 3 is a section on the line III—III of FIG. 2.
Figure 4:
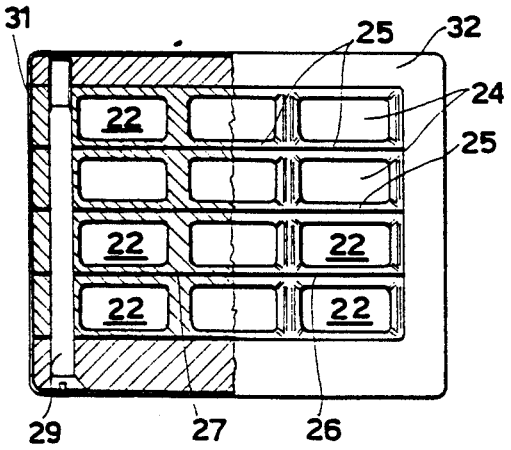
FIG. 4 is a front view partly sectioned on the line IV—IV of FIG. 2.

The ducts 15 are connected to the air filter, also not shown. The duct 13 comprises an inlet portion 18 of substantially rectangular cross-section and a terminal portion 19 of substantially circular cross-section. In the portion 18 there is mounted a non-return flap valve unit indicated overall by 20. As can also be seen from FIGS. 2 and 4 the unit 20 is formed from superposed modules 21 each consisting of three longitudinal channels 22 with substantially arcuate base walls indicated overall by 23.

In correspondence with their inlet sections 24 the channels 22 comprise ledges indicated by 25 and support surfaces indicated by 26, between which the fixing tabs 27 of the elastically flexible flaps 28 are clamped when the modules 21 are assembled by means of the screws 29 and 30.

The reference numeral 31 indicates a gasket which embraces the contour 32 of the unit 20 after the modules 21 and flaps 28 have been assembled, and which provides sealing for the unit when in the seat 17 of the duct 18.

In correspondence with their outlet section 33, the channels 22 comprise edges 34 in which grooves 35 are provided to house seal gaskets 36, for example of vulcanised rubber. On their inner side, the base walls 23 of the channels 22 have a curved surface 37 suitable for guiding the air stream passing through the channels, whereas on their outer side they comprise an end-of-travel surface 38 for halting the flaps 28 when in their open position. The end-of-travel surfaces 38 have the same shape as the flaps 28 when deformed under a uniformly distributed load (corresponding to a determined pressure difference), and are joined to the support surfaces 26 by step-shaped regions indicated by 39. The flaps 28 close the channels 22 by being urged by their own elastic reaction against the edges of the channels 22, this also happening when the engine is operating without a positive pressure difference between the upstream and downstream sides of the unit 20.

However, during each cylinder intake stroke, the flaps 28 are lifted from the edges of the channels 22 by the effect of the positive pressure difference between the upstream and downstream sides of the unit 20, and allow the air-petrol mixture to flow through the channels 22.

At the end of the cylinder intake stroke, the positive pressure difference across the unit 20 reduces and the flaps 28 again close the channels 22. In this condition, if the engine runs at low speed, especially under full induction with the throttle or throttles completely open, there is a return flow of cylinder mixture into the duct 13, where it is retained and assumes a certain overpressure by the closure of the valve 12 and flaps 28.

The unit 20 is very compact and can therefore be located within that portion 18 of the duct 13 provided in the cylinder head 10, so minimising the space between the intake valve 12 and the unit 20 and thus facilitating the pressure rise in the mixture which flows back into the duct 13. The mixture which has flown back into the duct 13 is again drawn into the cylinder during its next intake stroke, and because of its overpressure it contributes to the expulsion of the gaseous combustion products from the cylinder with a scavenging effect which also occurs at low engine speed. An overall increased cylinder filling effect is therefore obtained at low engine speed.

The contact between the flaps 28 and gaskets 36 provides a good seal even after many hours of operation, and deadens the impact of the flaps to the advantage of their life. The clamping of the tabs 27 between the ledges 25 and support surfaces 26 also ensures good sealing at the channel inlet sections 24. There is therefore no need to use seal gaskets, which would lead to a reduction in the area of the inlet sections 24 and reduce the permeability of the channels 22. A particular advantage is the shape of the outer side of the base walls 23, comprising end-of-travel surfaces 38 having the same shape as a deformed flap 28, and step-shaped regions 39 joining up with the support surfaces 26.

In this manner the flaps 28 rest totally against the end-of-travel surfaces 38 and do not undergo deformation. In addition the stresses to which the flaps are subjected in proximity to their region of clamping between the ledges 25 and support surfaces 26 are precisely controlled because the regions 39 can be machined to very narrow tolerances and can therefore be constructed with perfectly defined dimensions for limiting the stresses to within the design specifications. Complete lifting of the flaps is therefore ensured, together with an extremely satisfactory life.

We claim:

1. A valve unit for an intake duct feeding an internal combustion engine cylinder, said valve unit comprising a plurality of longitudinal channels assembled into superposed modules, each channel having a substantially arcuate base wall and an elastically flexible flap for the purpose of opening and closing a respective channel whereby said valve unit consists of non-return valve means in series with an intake valve of the internal combustion engine, each channel having an inlet section and an outlet section, the inlet section comprising a ledge and a support surface which are clamped with a fixing tab when the modules are formed, each fixing tab being provided on one of said flaps, each base wall having an increasing thickness extending towards the outlet section of the respective channel, each base wall having an inner face and an outer face, the inner and outer faces each having a bending radius, the inner face having a different bending radius than the bending radius of the outer face thereby providing a gradual slight reduction of the respective chamber towards the outlet section of the respective chamber, each base wall being provided with a slot, each slot housing a tight sealing gasket material, and each slot extending through a portion of the base wall.

2. The valve unit as claimed in claim 1, wherein on the outer side of their base wall (23) said channels (22) comprise end-of-travel surfaces (38) for halting the flaps (28) in their open position and having the same shape as the flaps (28) when these are deformed under a uniformly distributed load, corresponding to a determined pressure difference.

3. The valve unit as claimed in claim 2, wherein said channels (22) comprise on the outer side of their base wall (23) step-shaped regions (39) which connect said end-of-travel surfaces (38) to said support surfaces (26).

4. The valve unit as claimed in claim 1, wherein when applied to an internal combustion engine having at least one intake duct feeding at least one engine cylinder, characterised in that the valve unit (20) is located in a seat (17) in an inlet portion (18) of the intake duct (13) provided within the cylinder head (10) positioned between an injector and a corresponding intake valve, said portion (18) having a substantially rectangular cross-section, the duct (13) having a terminal portion (19) of substantially circular cross-section in proximity to the cylinder intake valve or valves (12).

5. The valve unit as claimed in claim 1, wherein the flexible blade of each module has a single base from which each individual flexible blade extends, and the single base has a shape corresponding to the brackets and support planes between which the single base is clamped.

* * * * *